US005551527A

United States Patent [19]

Luscombe

[11] Patent Number: 5,551,527

[45] Date of Patent: Sep. 3, 1996

[54] LIFT DEVICE FOR A THREE POINT HITCH

[76] Inventor: Terry Luscombe, Highway 15 South, Box 108, Armstrong, Iowa 50514

[21] Appl. No.: 317,188

[22] Filed: Oct. 3, 1994

[51] Int. Cl.[6] ..... B66F 11/04

[52] U.S. Cl. ..... 182/2; 182/141

[58] Field of Search ..... 182/2, 63, 141; 414/608

[56] References Cited

U.S. PATENT DOCUMENTS

| | | | |
|---|---|---|---|
| 2,820,561 | 1/1958 | Meagher | 182/141 X |
| 2,966,956 | 1/1961 | Campbell | 182/141 X |
| 3,285,365 | 11/1966 | Longton | 182/141 X |
| 3,415,339 | 12/1968 | Range | 182/2 |
| 4,116,304 | 9/1978 | Durnell | 182/2 |
| 4,936,414 | 6/1990 | Rybka | 182/2 |

*Primary Examiner*—Alvin C. Chin-Shue
*Attorney, Agent, or Firm*—Herman H. Bains

[57] ABSTRACT

A lift apparatus includes a lift device and a hitch and mounting assembly for connection to the three point hitch of a conventional tractor. The lift device includes a lower boom and an upper boom pivotally connected together and connected to an occupant bucket. The boom arm is connected to a turntable mounted on a base. The base is secured to and support on a support frame of the hitch and mounting assembly. A vertically disposed hitch frame is rigidly secured to the support frame and is provided with hitch members for connection to the three point hitch of a conventional tractor.

4 Claims, 2 Drawing Sheets

LIFT DEVICE FOR A THREE POINT HITCH

FIELD OF THE INVENTION

This invention relates to a lift apparatus and more particularly to a lift apparatus which is connectible to the conventional three point hitch of a tractor.

BACKGROUND OF THE INVENTION

Lift devices are typically mounted on utility vehicles or pick-up trucks. Lift devices include a lower boom arm connected to a turn table and connected to a telescoping upper boom arm. An occupant bucket is usually connected to the upper arm, and such lift devices perform a variety of functions.

Tractors, agricultural and industrial, have three point hitches for connection to various type implements. Applicant is unaware of a lift device constructed for connection to the three point hitch for a tractor.

SUMMARY OF THE INVENTION

It is an object of this invention to provide a novel lift apparatus having a mounting and hitch assembly for connection to the three point hitch of a conventional tractor. The apparatus includes a lift device including an upper boom arm connected to a lower boom arm which in turn is connected to a base. An occupant bucket is secured to the outer end of the upper boom arm.

A mounting and hitch assembly includes a generally horizontal mounting frame which is connected to and supports the base of the lift device thereon. A hitch frame is rigidly secured to the mounting frame and projects upwardly therefrom. The hitch frame has clevis type hitch connections thereon for connection to the three point hitch of a tractor. The lift apparatus may be readily transported by a tractor to the various locations thereby increasing its utility for use in fruit harvesting, painting, building and light maintenance, three trimming or similar farm or industrial uses.

FIGURES OF THE DRAWING

EMBODIMENT OF THE INVENTION

Figures 1, 2:
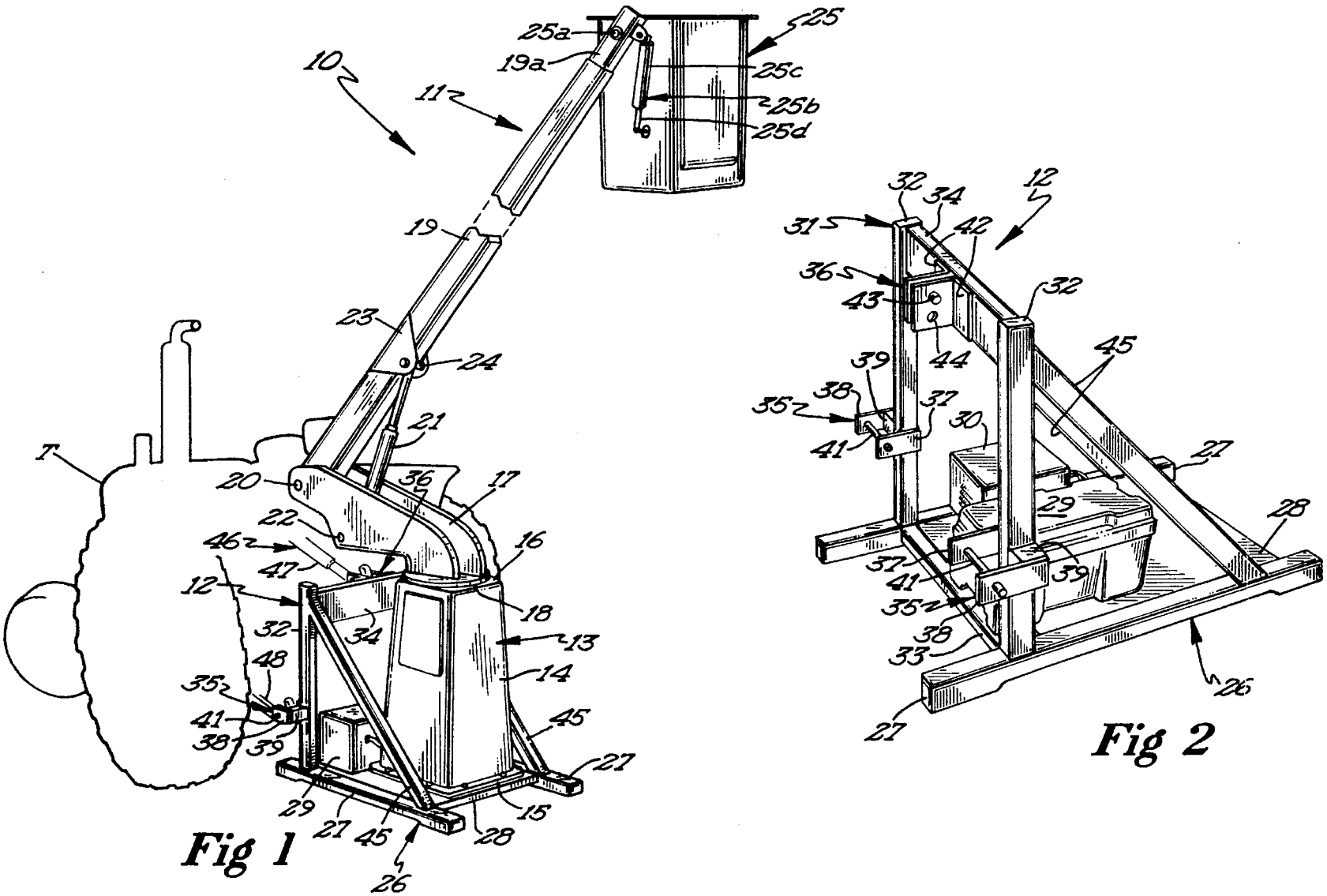
FIG. 1 is a perspective view of the novel lift apparatus.
FIG. 2 is a perspective view of the mounting and hitch assembly.
Figure 3:
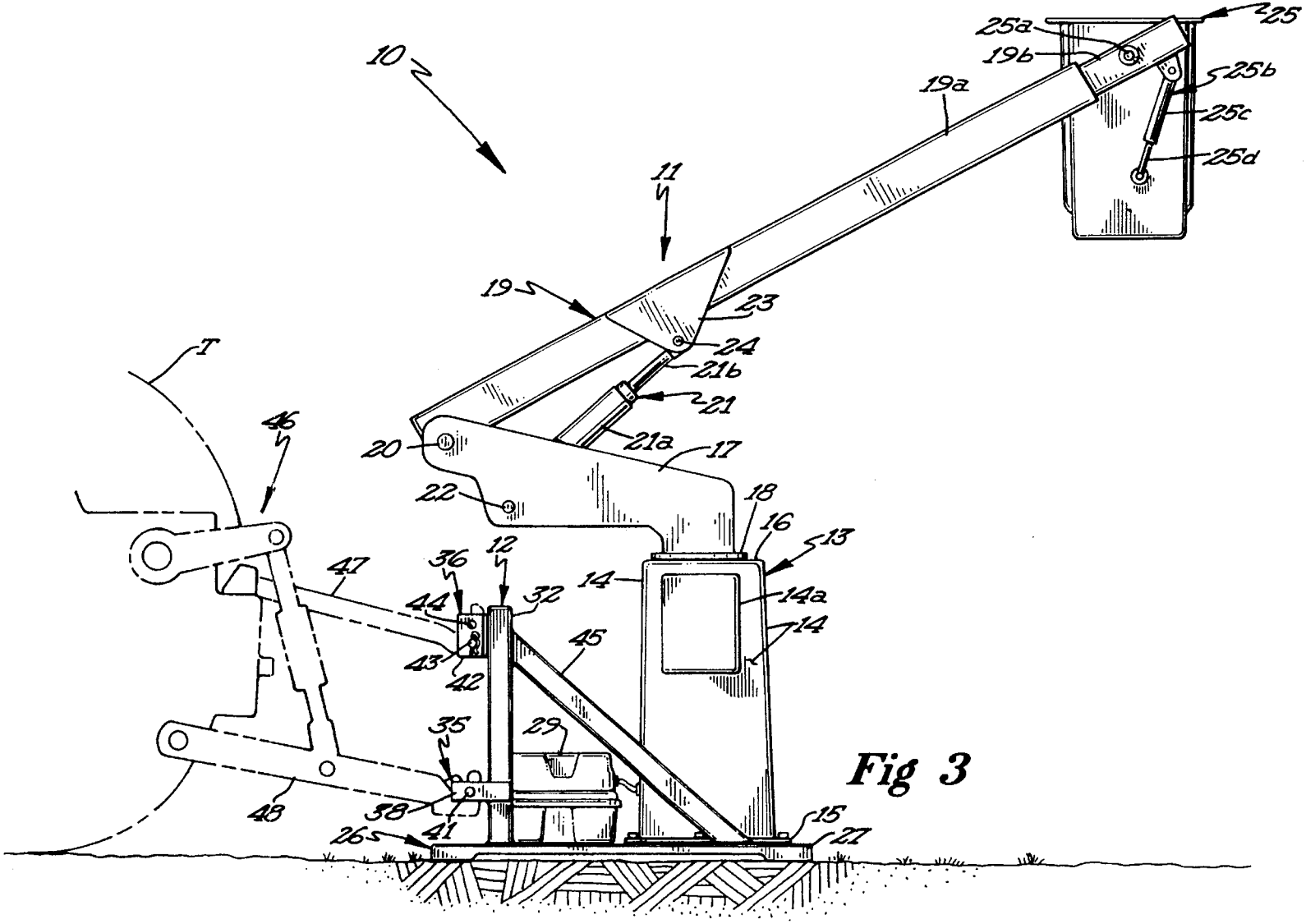
FIG. 3 is a side elevational view of the lift apparatus.

Referring now to the drawings and more specifically to FIG. 1, it will be seen that one embodiment of the novel lift apparatus, designated generally by the reference numeral 10 is thereshown. The lift apparatus 10 is connected to the three point hitch 46 of a conventional tractor T. The lift apparatus includes a lift device 11 mounted on and interconnected to the three point hitch 46 of the tractor T by a mounting and hitch assembly 12.

The lift device 11 comprises a base or pedestal 13 which includes four vertical side walls 14, a bottom wall 15, and a top wall 16. It will be noted that the vertical side walls 14 are generally trapizoidal in configuration. The top wall 16 has a turn table 18 revolvably mounted thereon. The lower end of an elongate lower boom arm 17 is rigidly connected to the turn table 18 and is moveable therewith. The turn table 18 is operated by a hydraulic motor and pump assembly (not shown) within the pedestal or base 13. A suitable electric motor (not shown) is also located inside the pedestal and provides motive power to the hydraulic pump.

The other end of the lower boom arm 17 is pivotally connected to one end of the inner section **19*a* of an elongate telescoping upper boom arm 19 by a pivot 20. The outer boom arm section 19*b* of the upper boom arm is telescopically received within the inner boom arm section 19*a*. A hydraulic piston and cylinder unit (not shown) is positioned within and interconnected to the inner and outer boom arm sections. Extension of this hydraulic piston and cylinder unit produces telescopic extension of the upper boom arm 19, and retraction of the hydraulic unit produces retraction of the upper boom arm 19**.

A double acting hydraulic piston and cylinder unit 21 includes a cylinder **21*a* which is pivotally connected by pivot 22 to the lower boom arm 17. The piston rod 21*b* of this unit is pivotally connected to a bracket 23 on the inner section 19*a* of the upper boom arm 19 by a pivot 24. It will be noted that the bracket 23 is rigidly affixed to the inner section 19*a* of the upper boom arm intermediate the ends thereof but closer to the lower end portion thereof. Extension and retraction of the hydraulic unit 21 produces angular movement of the upper boom arm 19** relative to the lower boom arm.

An open top occupant supporting bucket 25 is pivotally connected to the upper end of outer section **19*b* of the upper boom arm by means of a pivot 25*a*. The bucket 25 is adapted to support an occupant during operation of the lift apparatus. In this regard, suitable controls (not shown) are provided on the bucket to permit the operator to operate the lift device while standing in the bucket. Controls 14*a* are also provided at the pedestal or base 14** to permit operation of the lift from the ground.

In the embodiment shown, a hydraulic leveling piston and cylinder unit **25*b* is interconnected to the upper end of the outer section of the upper boom arm 19*b* and the bucket 25. The hydraulic unit 25*b* includes a cylinder 25*c* pivotally connected to the outer section 19*b*, and a piston rod 25*b* pivotally connected to the bucket 25. Control of the leveling device is located on the bucket 25** to permit an occupant to level the bucket.

The mounting and hitch assembly 12 includes a generally rectangular shaped mounting frame 26 which is comprised of a pair of elongate longitudinal parallel frame members 27 rigidly interconnected by a rectangular plate 28. A transverse frame member 33 also extends between and rigidly interconnects the longitudinal frame members 27. The base 13 is positioned upon and secured to the rectangular plate 28 by suitable bolts or the like to rigidly mount the entire lift device on the support frame 26. The support frame 26 also supports a deep cycle battery 29 and a 50 AMP automatic battery charger 30 thereon. The battery 29 gives approximately 3.5 hours of continuous boom operation. The battery is recharged by the battery charger 30 when needed.

The mounting and hitch assembly 12 also includes a vertically disposed hitch frame 31 comprised of a pair of spaced apart substantially parallel vertical frame members 32 each rigidly connected at its lower end to one of the longitudinal frame members 27 of the mounting frame 26 adjacent the front end of the mounting frame. It will be noted that the junction between the vertical and longitudinal frame members is adjacent the junction of the transverse frame member 33 and longitudinal frame members. An upper transverse frame member 34 extends between and rigidly interconnects the vertical frame members 32 at their upper ends. Suitable oblique interconnecting frame members 45 extend between and hitch interconnect a vertical frame member 32 with one of the longitudinal frame members 27.

The hitch frame 31 is porvided with a pair of lower clevis type hitch connections 35 and an upper clevis type hitch connection 36 for interconnection with the three point hitch 46 of the tractor T. It will be noted that each lower clevis type hitch connection is mounted on one of the vertical frame members 32 intermediate the ends thereof while the upper clevis type hitch connection is affixed to the upper transverse frame member 34 adjacent the mid point thereof.

Each lower clevis type hitch connection includes an inner vertical plate 37 and an outer vertical plate 38 affixed to opposite sides of a vertical frame member 32 in substantially parallel relation with respect to each other. It will be noted that the outer vertical plate 38 of each lower hitch connection 35 has a spacer 39 interposed between the vertical frame member 32 and the plate. Each outer plate 38 also has an in turned lip 40 at the front end thereof and projecting inwardly therefrom. A hitch engaging transverse pin 41 extends through suitable openings in the clevis plates and provides the means for connecting the lower three point hitch arms to these lower clevis type hitch connections.

The upper clevis type hitch connection is comprised of a pair of L shaped plates 42 which are rigidly secured to the upper transverse frame member 34 and project outwardly therefrom. The outwardly projecting portions of each of the plates are disposed in parallel relation and each has a pair of openings 44 therein, as best seen in FIG. 2. Each opening in one clevis plate is disposed in aligned relation with an opening in the other clevis plate. A pin 43 projects through and is secured in one pair of registering openings 44. The pin 43 may be positioned in either of the pairs of openings 44.

The hitch connections on the hitch frame are connected to the hitch arms of the three point hitch in a conventional manner. The upper hitch arm 47 connects to the pin 43 and the lower hitch arms 48 connect to the pins 41 on the lower hitch connections. The hitch frame may be readily connected to a three point hitch in a manner of minutes and the hitch frame may be connected to any category 2 or category 3, narrow standard three point hitch.

When the lift device is mounted on the mounting and hitch assembly and is connected to a tractor via a three point hitch 46, then the lift device can be readily moved from one location to another. When it is desirable to use the lift device, it can be lowered to ground level and can be used with out riggers on any conventional tractor.

Thus it will be seen that I have provided a novel lift apparatus including a mounting and hitch frame assembly which permits ready connection to a standard three point hitch of a suitable tractor. This arrangement extends the utility of lift devices in both the industrial and agricultural fields.

What is claimed is:

1. A lift apparatus adapted to be connected to the three point hitch of a conventional tractor, the tractor having front and rear ends, the three point hitch operatively connected to the rear end of the tractor and including a pair of lower hitch arms and an upper hitch arm, comprising;

a lift device including a base, a lower boom arm connected to the base, a telescoping upper boom arm pivotally connected to the base, a telescoping upper boom arm pivotally connected to the lower boom arm, and an occupant bucket connected to the upper boom arm, a mounting hitch assembly including a substantially horizontally disposed support frame connected to and supporting the base of the lift device thereon, a hitch frame rigidly connected to the support frame and projecting upwardly therefrom, a plurality of hitch engaging elements including an upper hitch element and a pair of lower hitch elements on said hitch frame for connection respectively, to the upper hitch arm and lower hitch arms respectively of the three point hitch of a tractor.

2. A lift apparatus adapted to be connected to the three point hitch of a conventional tractor, the tractor having front and rear ends, the three point hitch operatively connected to the rear end of the tractor and including a pair of lower hitch arms and an upper hitch arm, comprising;

a lift device including an upstanding base, a revolvable turn table on said base, an elongate boom arm having one end thereof secured to said turn table, an elongate telescoping upper boom arm including an elongate inner section having one end thereof pivotally connected to the other end of said lower boom arm, an occupant bucket secured to the other end of said upper boom arm, a mounting hitch assembly including a horizontally disposed mounting frame connected to and supporting the base thereon, a hitch frame secured to said mounting frame and projecting upwardly therefrom, hitch engaging means including an upper hitch element and a pair of lower hitch elements secured to said hitch frame for connection, respectively to the upper said hitch frame for connection, respectively to the upper hitch arm and lower hitch arms, respectively, of the three point hitch of a tractor.

3. The lift apparatus as defined in claim 2 wherein said mounting frame includes a plate defining a horizontal platform.

4. The lift apparatus as defined in claim 2 wherein said mounting frame has front and rear ends and said hitch frame is mounted on the mounting frame adjacent the front end thereof.

* * * * *